US006514151B2

(12) United States Patent
Delaplane

(10) Patent No.: US 6,514,151 B2
(45) Date of Patent: Feb. 4, 2003

(54) TRAINING DEVICE FOR GOLFERS

(76) Inventor: Nick Delaplane, 2545 Willow Creek Ct., Evans, GA (US) 30809

( * ) Notice: Subject to any disclaimer, the term of this patent is extended or adjusted under 35 U.S.C. 154(b) by 0 days.

(21) Appl. No.: 09/975,079

(22) Filed: Oct. 12, 2001

(65) Prior Publication Data

US 2002/0042304 A1 Apr. 11, 2002

Related U.S. Application Data

(63) Continuation-in-part of application No. 09/814,048, filed on Mar. 22, 2001, which is a continuation-in-part of application No. 09/476,081, filed on Jan. 3, 2000.

(51) Int. Cl.[7] ..... A63B 69/36
(52) U.S. Cl. ..... 473/268; 473/406
(58) Field of Search ..... 473/268, 266, 473/270, 278, 150, 406, 257

(56) References Cited

U.S. PATENT DOCUMENTS

| | | | | |
|---|---|---|---|---|
| 1,527,786 | A | * | 2/1925 | Cole |
| 1,596,110 | A | | 8/1926 | Lynch |
| 1,616,059 | A | | 1/1927 | Mulvehill |
| 1,638,448 | A | | 8/1927 | Manson |
| 1,678,944 | A | | 7/1928 | Jacobsen |
| 1,761,532 | A | * | 6/1930 | Morris |
| 1,803,907 | A | | 5/1931 | Kruse |
| 2,107,944 | A | | 2/1938 | Howard |
| D161,283 | S | | 4/1950 | Rogers |
| 3,347,551 | A | | 10/1967 | Dreyfus |
| 3,468,545 | A | | 9/1969 | Anderson |
| 3,622,159 | A | | 11/1971 | Morton |
| 3,883,144 | A | * | 5/1975 | Lazow |
| 3,899,179 | A | * | 8/1975 | Vlach |
| 4,128,245 | A | * | 12/1978 | Vlach |
| 4,151,990 | A | * | 5/1979 | Josenhans |
| 4,915,387 | A | * | 4/1990 | Baxstrom |
| 5,133,556 | A | * | 7/1992 | Karasavas |
| 5,240,254 | A | * | 8/1993 | Adlam |
| 5,437,448 | A | * | 8/1995 | Balson |
| 5,449,176 | A | | 9/1995 | Schwab, Jr. |
| 5,743,819 | A | | 4/1998 | Chun |
| D399,896 | S | | 10/1998 | Plain |
| 6,024,654 | A | | 2/2000 | Chun |

* cited by examiner

*Primary Examiner*—Paul T. Sewell
*Assistant Examiner*—Nini F. Legesse
(74) *Attorney, Agent, or Firm*—Rothwell, Figg, Ernst & Manbeck, pc

(57) ABSTRACT

The present invention is directed to a training device for use by golfers to help them establish a shot routine to consistently line up, set-up, maintain a fixed head position during the golf swing and act as a guide or target to direct the club head during the down swing. The training device is shaped and arranged relative to the ball such that it presents a visual indication of head position to a player as he executes his golf line up, set-up and swing.

34 Claims, 6 Drawing Sheets

TRAINING DEVICE FOR GOLFERS

CROSS-REFERENCE TO RELATED APPLICATION

The present application is a continuation-in-part application of U.S. patent application Ser. No. 09/814,048 filed on Mar. 22, 2001, which in turn is a continuation-in-part application of U.S. patent application Ser. No. 09/476,081 filed on Jan. 3, 2000, both incorporated herein by reference.

BACKGROUND OF THE INVENTION

The present invention is directed to a training device for use by golfers to help them establish a pre-shot routine to consistently line up, set-up, maintain a fixed head position during the golf swing and act as a guide or target to direct the club head during the down swing. The training device is shaped and arranged relative to the ball such that it presents a visual indication of head position to a player as he executes his golf line up, set-up and swing.

It is well known that weekend golfers routinely hit dramatically different shots from one swing to the next, i.e., a few good ones mixed in with many bad shots. Golf instructors have long recognized that the number one reason high handicappers hit inconsistently is because their golf swing set-up changes from one swing to the next. Golfers cannot expect to hit the ball the same way every time when they set up to it differently every time.

The importance of maintaining the head still during the golf swing and to keep one's eye on the ball is well known and is explained by golf teaching professionals. These professionals teach that it is desirable for a golfer to keep his head in a fixed position so that his eyes constantly focus on the golf ball while swinging a golf club. It is a common phenomenon for golfers to move the head while moving other parts of the body during the golf swing. The resulting consequences of head movement are well known often resulting in poorly hit balls. Several different devices have been manufactured to either train a golfer in maintaining a fixed head position or to assist a golfer in analyzing his golf swing.

One such device is described in U.S. Pat. No. 5,449,176. The device is a small, brightly colored crescent that is placed under the ball out of sight of the golfer. The device provides a bright object for the golfer to see after he has hit the ball, which ensures that he has kept his head down.

A second device is described in U.S. Pat. No. 3,622,159. The device comprises a longitudinal shank having a brightly colored element position on the shank below the head of the shank. In practice, the shank which is placed in the ground adjacent to the golf ball and aligned to just obscure the brightly colored element. The golfer focuses on the head of the shank rather than the ball. This brightly colored element will appear if the golfers head moves from his original alignment during his golf swing. According to this patent, it is not necessary to maintain a fixed line of sight on the ball to hit the ball properly, but rather it is a matter of keeping the head still. Despite this device and others known in the art, there remains a need for a small, readily portable training device which can be used on a driving range or on a golf course during a round of golf to assist the golfer to consistently line up, set-up, maintain a fixed head position during the golf swing and act as a guide or target to direct the golfer's hands and club head during the down swing.

Thus, it is an object of the present invention to provide a training device that is small and readily portable and that once positioned properly will assist the golfer to consistently line up, set-up, maintain a fixed head position during the golf swing and act as a guide or target to direct the golfer's hands and club head during the down swing.

SUMMARY OF THE INVENTION

The present invention is directed to a training device for use by golfers to help them establish a shot routine to consistently line-up, set-up, maintain a fixed head position during the golf swing and act as a guide or target to direct the golfer's hands and club head during the down swing.

In accordance with one embodiment of the present invention, a training device is provided, the upper portion of which is relatively shaped to the size of a golf ball and which has a positioning means which allows for positioning of the golf ball with respect to the training device. The training device is designed for adjustable disposition behind and below the golf ball. Other embodiments of the present invention allow for adjustment of the device with respect to the golf ball and use of the device for tee shots as well as fairway shots. For example, since the player must stand at different distances from the ball depending on which club is used, the training device in one embodiment has a slot that allows the training device to be moved to remain in a just obscured position in relation to the various aligned viewing positions dictated by the length of the club in use.

Thus, in accordance with the present invention, a training device is provided which is shaped and arranged relative to the ball such that it presents a visual indication of head position to a player as he executes his golf line up, set-up and swing. The upper portion of the device is sized such that the device can be positioned where the upper portion can be just obscured below the golf ball that indicates proper positioning during the initial line-up of the golfer to both the ball and the target. Before executing his swing, the golfer's next step is to lean his upper body several degrees away from the target that places him slightly behind the ball. In this new position and while focusing on the ball he now has a background view of a small slice of the upper portion of the device because the ball no longer obscures all of the upper portion of the device. By retaining this preferred view of the device throughout his back swing and forward swing he will maintain a fixed head position and execute a proper swing. Thus, if he sees too much of the device left of the marks on the device he has leaned too far to the right. If he sees too much of the top of the device he has too much weight on his toes and will be unbalanced. If he sees the left side of the device he has leaned too far toward the target (a reverse weight shift). Each of these views will indicate to him what to correct on his next swing.

Another important feature of the device according to the present invention is the angle of the right edge of the device (left edge for left handed golfers). This angle is chosen such that it is the desired angle of approach of the golfer's hands and club head during the down swing to properly hit the ball. This edge is an important visual guide to constantly remind the golfer the club head approach angle.

DETAILED DESCRIPTION OF THE INVENTION

Figure 1:
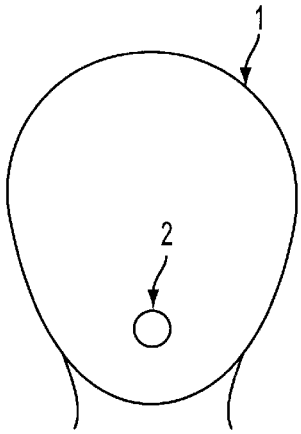
FIG. 1 is a top plan view of a training device according to one embodiment of the present invention.

It is a fully substantiated fact that one must always keep his eye on the ball throughout the entire shot to perform successfully. The present invention recognizes this critical need to always keep one's eye on the ball and describes an adjustable device that permits this function. It is placed on the ground below the ball, thus allowing the golfer to focus on the golf ball while he can still see the device in the background, which he uses to line up, set up and swing. The brightly colored device will give him visual feed back of the position of his head at each stage of his shot routine by being partially obscured during the correct lineup and then partially appearing from behind the ball during his set-up and swing. The amount and side of the device that appears will indicate in what direction and how much the head moved during each phase of his set-up and swing.

Thus, the present invention is directed to a training device for use by golfers to help them establish a shot routine to consistently line-up, set-up, maintain a fixed head position during the golf swing and act as a guide or target to direct his hands and the club head during the down swing. The training device is shaped and arranged relative to the ball such that it presents a visual indication of head position to a player as he executes his golf line up, set-up and swing.

In accordance with the present invention, a training device is provided which is shaped and arranged relative to the ball such that it presents a visual indication of head position to a player as he executes his golf line up, set-up and swing. The upper portion of the device is sized such that the device can be positioned where the upper portion can be just obscured below the golf ball that indicates proper positioning during the initial line-up of the golfer to both the ball and the target. Before executing his swing, the golfer's next step is to lean his upper body several degrees away from the target that places him slightly behind the ball. In this new position and while focusing on the ball, he now has a background view of a small slice of the upper portion of the device because the ball no longer obscures all of the upper portion of the device. By retaining this preferred view of the device throughout his back swing and forward swing he will maintain a fixed head position and execute a proper swing. Thus, if he sees too much of the device left of the marks on the device he has leaned too far to the right. If he sees too much of the top of the device he has too much weight on his toes and will be unbalanced. If he sees the left side of the device he has leaned too far toward the target (a reverse weight shift). Each of these views will indicate to him what to correct on his next swing.

Another important feature of the device according to the present invention is the angle of the right edge of the device (left edge for left-handed golfers). This angle is chosen such that it is the desired angle of approach of the golfer's hands and club head during the down swing to properly hit the ball. This edge is an important visual guide to constantly remind the golfer of the correct approach angle.

In order to facilitate an understanding of this invention, it is hereafter described in connection with its use as an aid to a golfer to indicate movements of his head while swinging a golf club. However, it is to be understood that this description is merely to illustrate the invention and thus not in any way limit the same.

Figure 2:
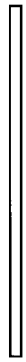
FIG. 2 is an elevation view of the training device shown in FIG. 1.

FIG. 1 is a top plan view of training device 1 according to one embodiment of the present invention. In FIG. 1, the training device 1 is relatively shaped to the size of a golf ball and has a positioning means represented by hole 2 in which a tee suitable for placement of a golf ball can be inserted. FIG. 2 is an elevation view of the training device shown in of FIG. 1.

Figure 3:
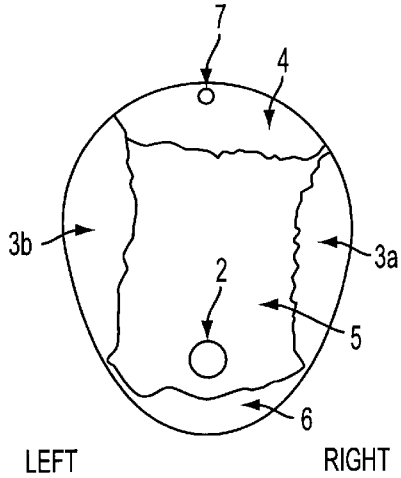
FIG. 3 is a top plan view depicting a training device according to a second embodiment of the present invention divided into regions for illustration.

FIG. 3 is a top plan view of a training device 1 according to a second embodiment of the present invention. In FIG. 3, the training device 1 is shown divided into regions so as to better describe the purpose of the design of the training device according to the present invention. As shown in FIG. 3, the training device 1 comprises a first side region 3*a* with an edge, a second side region 3*b* with an edge, an upper region 4 with an edge, a central region 5 and a bottom region 6. The training device also has a retrieving hole 7 for use in retrieving the device after the golf swing.

Figure 4:
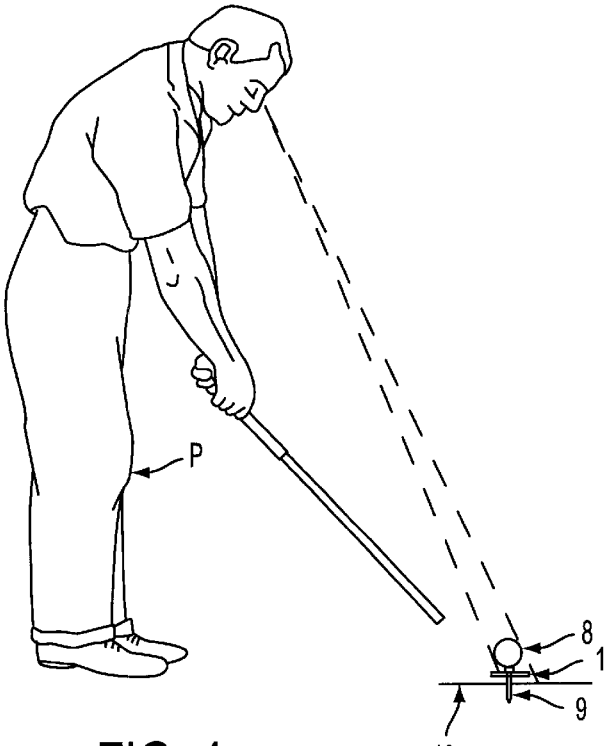
FIG. 4 is a side elevation depicting the use of the training device shown in FIG. 1 by a golf player.

FIG. 4 is a side elevation of a player P who has positioned the training device 1 on a playing surface 10 and placed above the training device 1 a golf ball 8 mounted on a golf tee 9 which has been inserted through hole 2 in such a manner that the golf ball 8 just obscures the training device 1 from his eyes as viewed from his stance.

Figure 5:
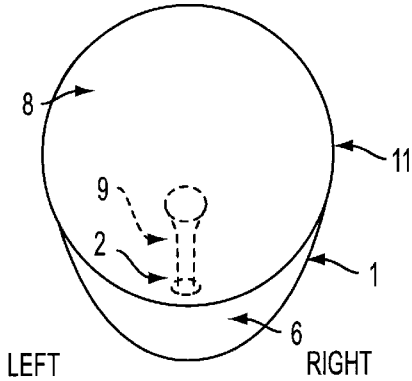
FIG. 5 is a diagonal view of the FIG. 1 device as viewed by a player when in use.

FIG. 5 is the view player P as positioned in FIG. 4 will observe of the golf ball 8 and training device 1 when the golf ball 8 is mounted on golf tee 9 inserted through hole 2. FIG. 5 illustrates the feature of the training device 1 being relatively shaped to the size of a golf ball, such that all of the regions of training device 1 are just obscured except for lower region 6 which will still be visible to player P but does not distract from the training benefit, as he is focusing on right edge 11 of the golf ball 8 to see if any portion of the edge of region 3*a* appears from behind the golf ball 8 during his final set-up, where he leans his upper body several degrees away from the target.

Use of the training device 1 with respect to positioning it relative to a golf ball is illustrated by reference to FIGS. 3–5 and based on a right- or left-handed golfer striking the golf ball 8. A description opposite to the following description will be true for a left-handed player. The first side region 3*a* in combination with the upper region 4 and/or the second side region 3*b* is shaped to be just obscured from the player P's line of sight by the golf ball 8 when the golfer is addressing the golf ball as shown in FIG. 4. Thus, in one aspect the shape of the second side region 3*b* is not as critical and can vary as long as it is obscured by the golf ball 8. In a second aspect, the training device 1 is symmetrical such that the shape of the first side region 3*a* and the shape of the second side region 3*b* are identical or nearly identical. This latter aspect allows the training device 1 to be used by either a right-handed player or a left-handed player. The central region 5 has the positioning means shown as a hole 2 that is used to accommodate the insertion of golf tee 9. The lower region 6 is not critical to the overall function of the device but partially accommodates hole 2 by providing material along the edge thus strengthening the training device 1. Retrieving hole 7 in the upper region 4 is provided in the event the player desires to attach a clip, string and/or anchoring device to more easily retrieve the training device 1. The body of the training device 1 will be of a sharply contrasting color to the golf ball 8 and the portion of lower region 6 that will not be obscured by the golf ball 8 may be of a color that blends into the natural turf or driving range platforms. The training device 1 will be made of a light-weight durable material, which will not damage a golf club but will withstand repeated blows from the golf club.

Figure 6:
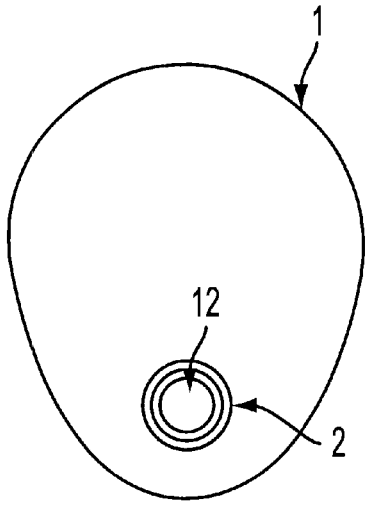
FIG. 6 is a top plan view of a training device according to a third embodiment of the present invention.

FIG. 6 is a top plan view of a training device 1 according to a third embodiment of the present invention. In this embodiment, the training device 1 has a wider hole 2 designed to accommodate driving range tee 12 such as found on most driving ranges.

Figure 7:
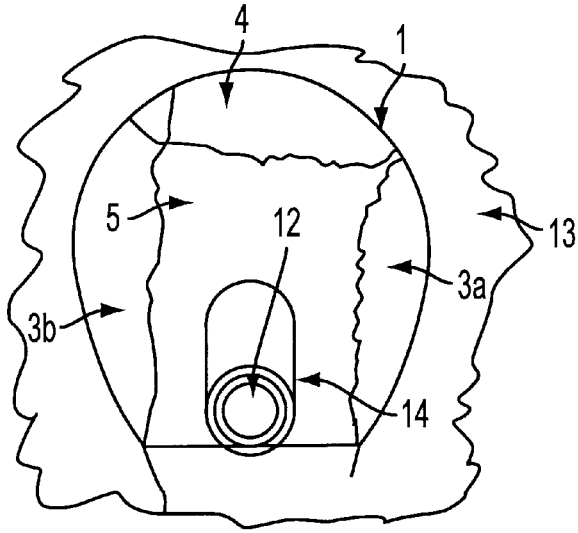
FIG. 7 is a top plan view of a training device according to a fourth embodiment of the present invention.

FIG. 7 is a top plan view of a training device 1 according to a fourth embodiment of the present invention. In this embodiment, the training device 1 is permanently printed on material 13 that is commonly found on man-made golf surfaces at golf driving ranges. The training device 1 is designed such that when a slot 14 is cut in the material 13 and a driving range tee 12 inserted through slot 14, the shape of the training device 1 printed on material 13 is such that the first side region 3*a* and second side region 3*b* (for left-handed players) in combination with the upper region 4 are of such a size and shaped such that a golf ball 8 when placed on the driving range tee 12 will just obscure the training device shape 1 from the player P's line of sight. Lower region 6 is not required, since training device 1 is printed on material 13 and no material strength is required.

Figure 8:
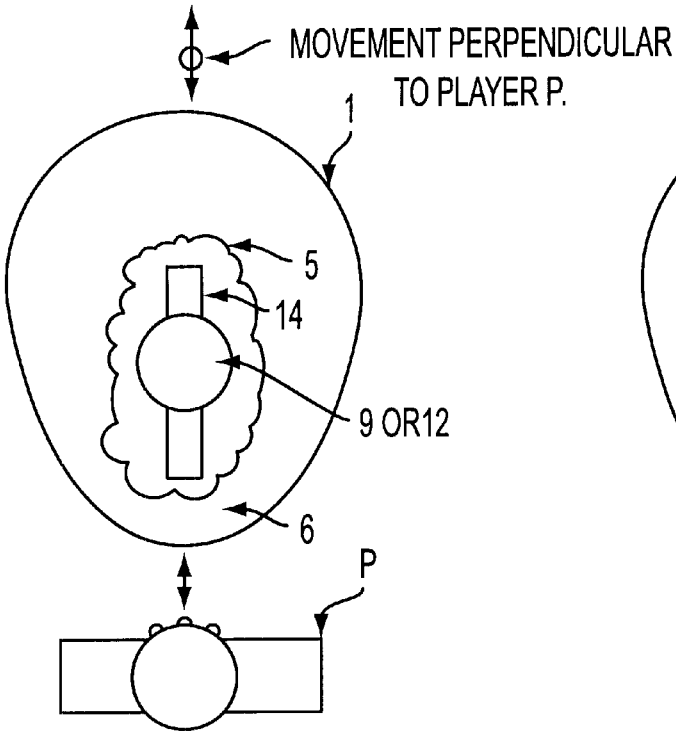
FIG. 8 is a top plan view of a training device according to a fifth embodiment of the present invention.

FIG. 8 is a top plan view of a training device 1 according to a fifth embodiment of the present invention. In this embodiment, the positioning means in central region 5 is a slot 14 which is of sufficient width to insert golf tee 9 or driving range tee 12, and is of sufficient length to allow the training device 1 to be positioned along the playing surface perpendicular to player P while still penetrated by either golf tee 9 or driving range tee 12, which remains in a fixed position because of being inserted into the ground 10. The use of slot 14 allows the golfer to adjust the position of the training device 1 with respect to the ball, as described further below.

Figure 9:
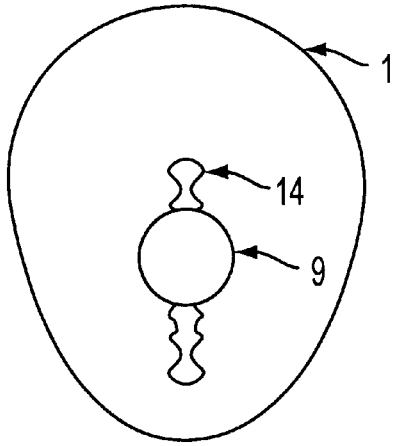
FIG. 9 is a top plan view of a training device according to a sixth embodiment of the present invention.

FIG. 9 is a top plan view of a training device 1 according to a sixth embodiment of the present invention. In this embodiment, slot 14 comprises means to hold the training device in any desired position along the shaft of the golf tee, which is inserted through the slot perpendicular to the training device. In the embodiment shown in FIG. 9, the slot 14 has been designed to leave portions of the material out of which training device 1 is made along the edges of slot 14, which will hold the training device 1 at any desired position along the shaft of a golf tee 9 inserted through slot 14. In an alternative aspect to this embodiment, the slot can be replaced by a series of holes down the center axis of the training device 1. In other words, the portions of material left along the edges of the slot in this aspect extend across the slot to form the series of holes.

Figure 10:
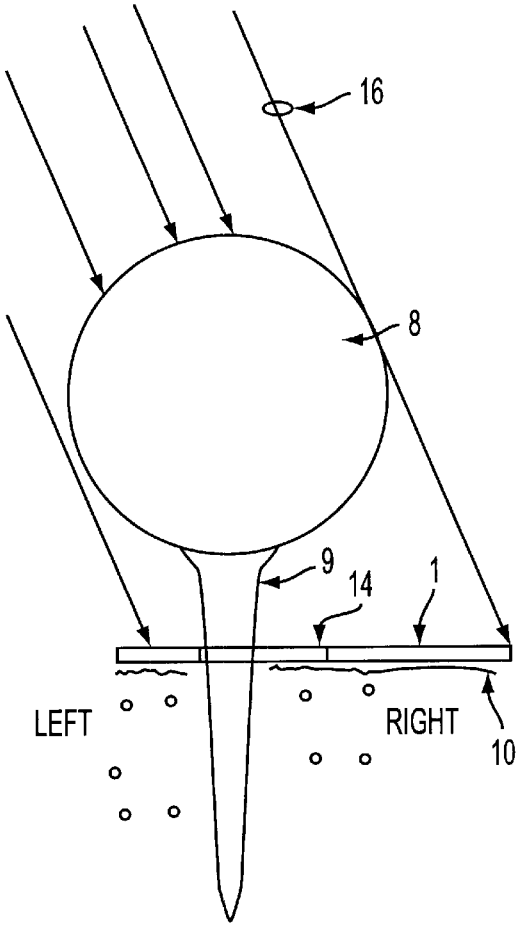
FIG. 10 is a side elevation of the training device shown in FIG. 1 illustrating how it is just obscured from the player's view by the golf ball.

FIG. 10 is a side elevation of the training device 1 of the embodiment shown in FIG. 8. In this figure, the training device 1 is shown on the ground 10 with a golf ball 8 mounted on golf tee 9, which is inserted through slot 14 into the ground 10. The training device 1 is positioned where it is just obscured from the player P, when he has assumed his normal ready position in this case when viewed from above, as in FIG. 4. Region 6 of training device 1 will be closest to the player, and region 4 will be furthest away from the player. The arrows 16 simulate the line of vision of player P to demonstrate how the device will be obscured from player P's line of sight by the golf ball 8. When moving closer to the golf ball 8 to adjust for shorter clubs, player P must reposition the training device 1 along the ground 10 closer to himself in a new, just-obscured position by means of slot 14 which slides along the golf tee 9, which remains in its original position inserted into the ground 10.

Figure 11:
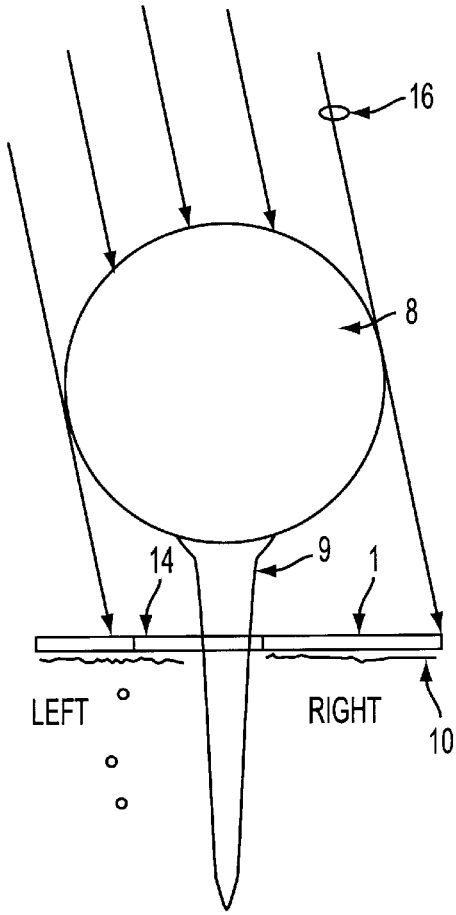
FIG. 11 is a side elevation of the training device shown in FIG. 1 illustrating how it can be moved to be just obscured when the player moves closer to the golf ball.

FIG. 11 is similar to FIG. 10 except that it shows player P having moved closer to the golf ball 8 to accommodate a shorter club. At the same time he has repositioned the training device 1 closer to himself along the ground 15 into a just-obscured position, to accommodate the different angle of view as a result of his moving closer to the golf ball 8. Note that the angle of simulated sight 16 of the player P is steeper thus indicating that he is closer to the golf ball 8.

Figure 12:
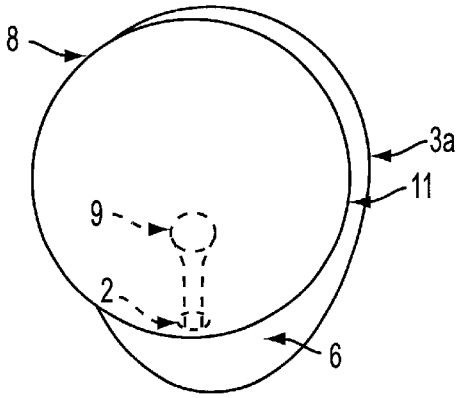
FIG. 12 is an illustration of the training device shown in FIG. 1 as viewed by the player when he has moved his head to far too the right.

FIG. 12 depicts the view player P will observe of the golf ball 8 and training device 1 as shown in FIG. 4 when the player P has shifted his upper body slightly to his right, away from the target as a final set-up before his back swing. A small slice of training device 1 will appear from behind golf ball 8. During his back swing, player P may shift more of his upper body to his right, away from the target, which will make slightly more of the edge of first side region 3*a* of training device 1 visible. If player P sees an excessive amount of this edge, he knows he has shifted too far away from the target to his right. If he sees the edge of upper region 4, he knows he has moved too much onto his toes. Both views or a combination of both give an excellent indication of his head movement and weight shift. Thus, the use of the training device 1 of the present invention allows the golfer to concentrate on maintaining head position and to focus on the golf ball during the golf swing.

Figure 13:
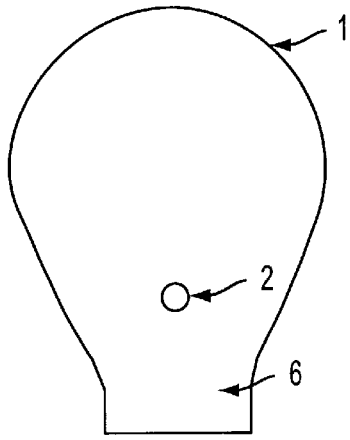
FIG. 13 is a top plan view of a training device according to a seventh embodiment of the present invention.

FIG. 13 is a top plan view of a training device 1 according to a seventh embodiment of the present invention. In this embodiment, the shape of lower region 6 has been extended to provide a protrusion where a player P can push with his club to make adjustments to the position of the training device 1 without bending down again to provide proper alignment of the training device 1 with the golf ball 8, depending on the golfer's height and club selection.

Figure 14:
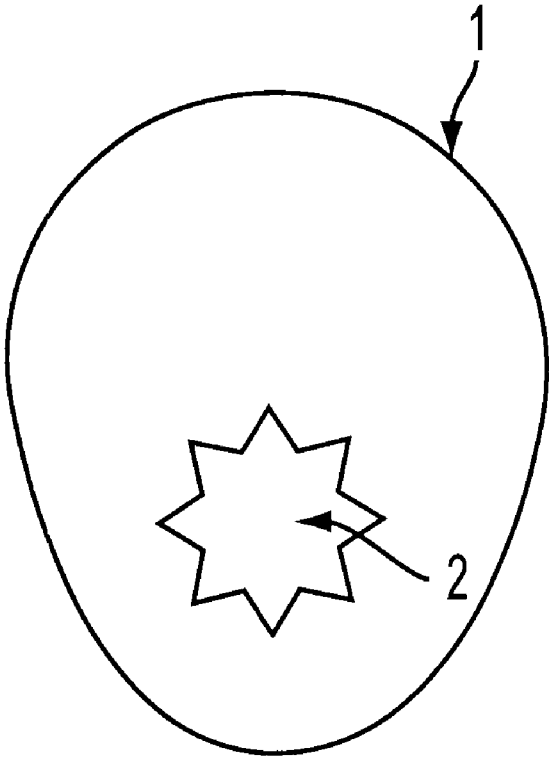
FIG. 14 is a top plan view of a training device according to an eighth embodiment of the present invention.
Figure 15:
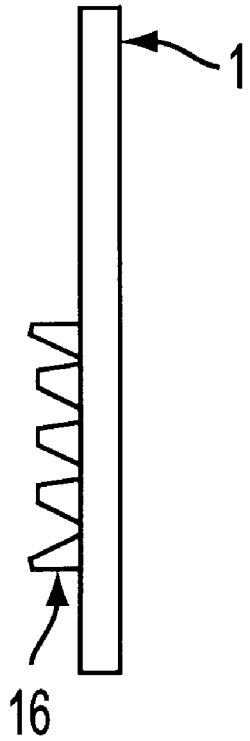
FIG. 15 is a side elevation of the training device shown in FIG. 14.

FIG. 14 is a top plan view of a training device 1 according to an eighth embodiment of the present invention. In this embodiment, a positioning means is a platform on the surface of said indicator to hold a golf ball without the need for a tee. In one aspect of this embodiment as shown in FIGS. 14 and 15, hole 2 is enlarged and designed to leave portions of the material of the training device 1 surrounding the hole 2. The portions of material surrounding hole 2 can be placed in a position perpendicular or nearly perpendicular to the training device 1 to form a platform 16 (shown in FIG. 15) on which a golf ball can be positioned. As in the other embodiments, the positioning means is designed so that the training device 1 will be just obscured by the golf ball placed on the circular platform 16. This embodiment provides for the use of the training device 1 without the need for a tee, such as use of the training device 1 for fairway shots. Obviously any attachment that can be added to training device 1, to form a similar platform to hold a golf ball, can be used for this embodiment.

Figure 16:
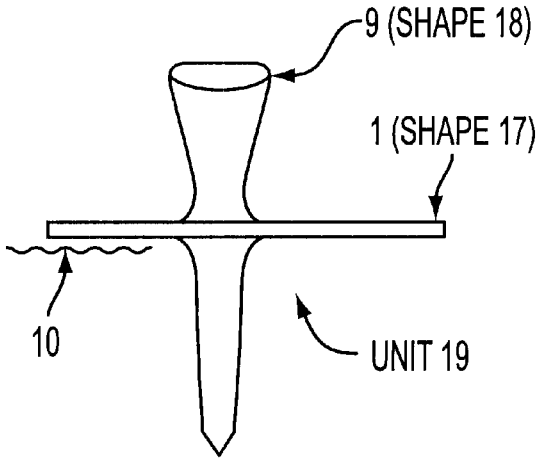
FIG. 16 is a side elevation of training device 1 according to a ninth embodiment of the present invention.

FIG. 16 is a side elevation of training device 1 according to a ninth embodiment of the present invention. In this embodiment, the training device 1 (shape 17) is combined with, and incorporates the golf tee 9 (shape 18), thus forming a single unit 19 wherein the training device 1 (shape 17) portion of unit 19 will be perpendicular to the golf tee (shape 18) portion of unit 19. In this embodiment, the golf tee (shape 18) portion serves the same purpose as a separate golf tee 9 as shown in FIG. 5, wherein the golf tee 9 (shape 17) portion of unit 19 will be inserted in the ground and the training device 1 (shape i7) portion of unit 19 will just lie on the ground and be just obscured from the golfer's line of sight when a golf ball 8 is placed on the top of the golf tee (shape 18) portion of unit 19. Single unit 19 may be manufactured by injection molding.

Since unit 19 is a single unit without a means to adjust the training device 1 (shape 17) portion into a just-obscured position relative to the position of the golf ball 8, as described in the fifth embodiment, it is the intent of this embodiment that the position of the golf tee (shape 18) portion of unit 19 can be placed anywhere along the training device 1 (shape 17) portion of unit 19 to provide a selection of unit 19 devices to accommodate the use of different length clubs.

Figure 17:
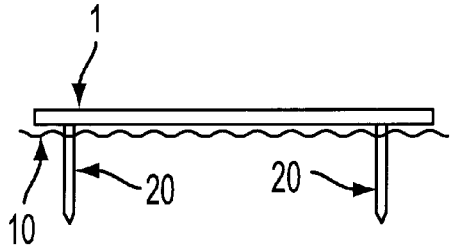
FIG. 17 is a side elevation of training device 1 according to a tenth embodiment of the present invention.

FIG. 17 is a side elevation of training device 1 according to a tenth embodiment of the present invention. In this embodiment, the training device 1 contains pointed anchoring devices 20, and when pressed into the playing surface 10, will hold the training device 1. This embodiment provides stability for the training device 1 when tee 9 is inserted through openings 2 or 14 located in central region 5, as depicted in FIGS. 5 and 8.

Figure 18:
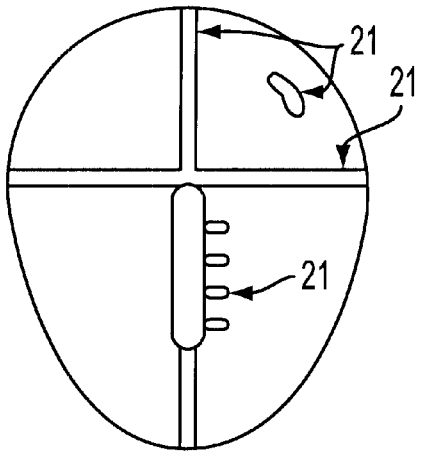
FIG. 18 is a plan view of training device 1 according to an eleventh embodiment of the present invention.

FIG. 18 is a plan view of training device 1 according to an eleventh embodiment of the present invention. In this embodiment, the training device 1 contains markings 21 which provide alignment guides for the golfer and other visual aids during the setup and golf swing. These markings are for illustration only, and are not intended to represent all available options.

Figure 19:
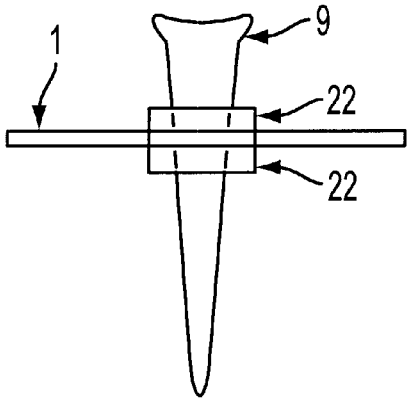
FIG. 19 is a side elevation of training device 1 according to a twelfth embodiment of the present invention.

FIG. 19 is a side elevation of training device 1 according to a twelfth embodiment of the present invention. In this embodiment, the training device 1 is held into position on tee 9 with devices 21 suitable to stay in place even after struck by a golf club. As in the other embodiments, the location of the training device 1 can be placed along the length of tee 9 such that it is just obscured by the golf ball placed on the top of tee 9.

Figure 20:
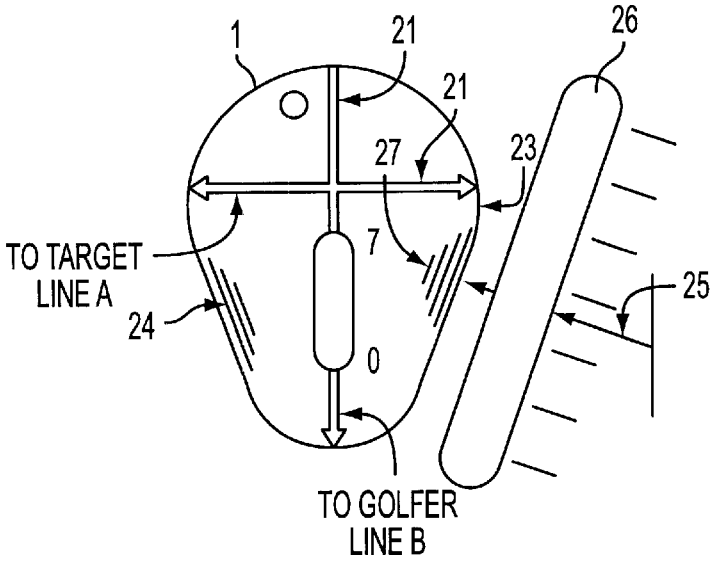
FIG. 20 is a top plan view of a golf training device 1 according to a thirteenth embodiment of the present invention.

In FIG. 20, in a thirteenth embodiment of the present invention, the first side region 3*a* and second side region 3*b* are shown with edges 23 (right-handed golfer) and 24 (left-handed golfer) at the proper angle to provide a guide for the golfer to position his club head before his swing. These edges then act as a visual reminder to show him the proper angle of approach 25 for his hands and his club head during the down swing. Markings 21 (see also FIG. 18) are provided to aid him in his initial alignment and markings 27 act as a guide for his final golf swing set-up and golf swing (see FIG. 22).

Figure 21:
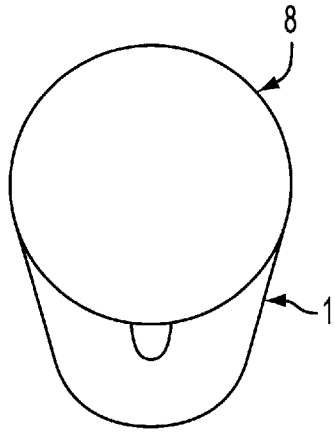
FIG. 21 is a top plan view of a golf ball 8 positioned over the training device of FIG. 20 during initial setup.

The following explains the use and function of the device, which helps the golfer, establish a shot routine that provides a consistent set-up for each shot. It provides visual feedback to the golfer during practice that helps him set-up and swing consistently for each shot. Referring to FIG. 20, device 1 is placed on the ground with line A pointed toward the desired direction of the ball 8. Tee 9 is inserted through slot 14 and a golf ball 8 placed on the tee 9. See FIG. 21. A mid-iron 26 is selected and the golfer assumes the position shown in FIG. 4. With his feet completely together and line B pointed between them, he positions himself such that a line could be drawn across the point of his toes parallel to line A. He will see the view of the ball 8 and the device 1 as shown in FIGS. 5 and 21 where the upper region 4 of the device 1 will just be obscured, thus indicating he is properly aligned to both the ball 8 and the desired direction of the ball 8. The golfer is aligned to the ball 8 and the target when the top edge of the ball 8 just obscures the upper region 4 of device 1 as shown in FIGS. 5 and 21. It is noted that the first time a golfer performs this alignment will require trial and error to get the tee 9 at the correct height and at the proper location in slot 14, but he will quickly learn the correct setup for each club.

Figure 23:
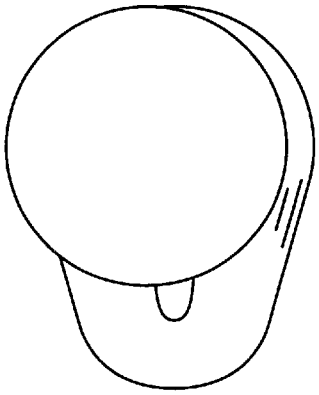
FIG. 23 is a top plan view of a golf ball 8 and training device 1 as viewed by a golfer prior to executing his swing.
Figure 22:
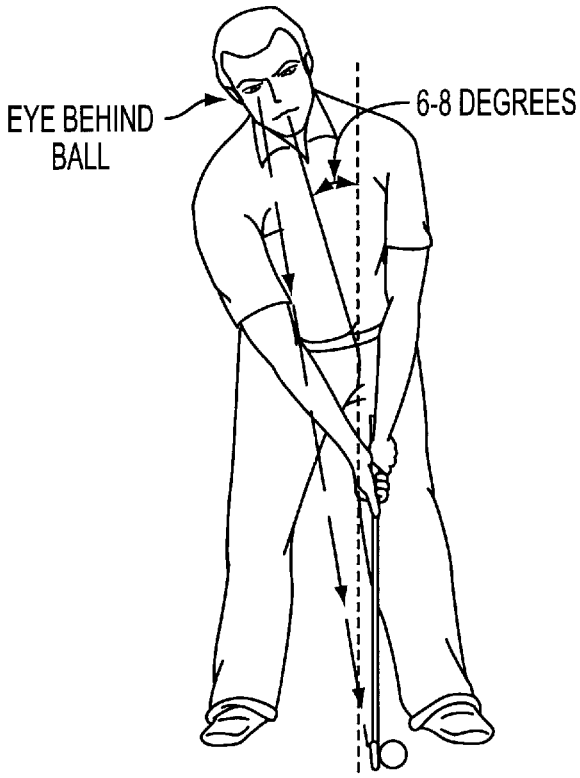
FIG. 22 is a side elevation depicting the use of the training device shown in FIG. 20 by a golf player.

As shown in FIG. 22, while keeping the previous alignment, the golfer will now widen his stance for the club selected, and will lean his upper body 8–9 degrees in the opposite direction away from the desired direction of the ball in order to assume the normally accepted final set-up just before swinging the club (normally known as being behind the ball). In this new position and while focusing on the ball 8, he now has a background view of a small slice of the device 1 (of the upper region and one of the side regions), because the ball 8 no longer obscures all of the upper portion of device 1 (specifically a portion of right hand region 3*a* and upper region 4 for a right-handed golfer, as shown in FIG. 23). Markings 27 are provided to help the golfer maintain the same view every time he sets up to hit the ball. By retaining this preferred view of the ball 8 and device 1 throughout his back swing and down swing, he will maintain a fixed-head position and execute a proper swing. During his down swing, he guides his hands and club head toward the ball perpendicular to edge 23 of training device 1, which is the accepted angle of approach 25 of his club head. By repeating this process, he will learn the correct visual feedback image and will be able to notice differences and correct them on the next swing.

The present invention has been described in detail above for purposes of illustration only and is not intended to be limited by this description or otherwise to exclude any variation or equivalent arrangement that would be apparent from, or reasonably suggested by, the forgoing disclosures to the skill of the art.

What is claimed is:

1. A golfer's aid for consistently executing a proper golf club swing comprising:

a substantially horizontal surface;

means for identifying a golf ball teeing point disposed on said surface;

a golf ball to be located on said teeing point, said golf ball being viewable by a golfer while addressing same, and first and second adjacent markings spaced apart from each other and at predetermined distances substantially linearly from said teeing point, the distance between said first marking and said teeing point being greater than the distance between said second marking and said teeing point, and the distance between said first marking and said teeing point being such that when a golf ball is positioned on said teeing point, and said thus positioned golf ball is being addressed by a golfer standing in a substantially proper golfing stance, said first marking is substantially obscured from said golfer's view by said thus positioned golf ball, and as said golfer executes a back swing and leans rearward, in a direction substantially opposite a direction in which the golf ball is to be driven, said second marking will come into said golfer's view and indicate the achievement of a substantially proper final set-up just before a down swing of the golf club begins.

2. The golfer's aid of claim 1 wherein said means for identifying a teeing point is a hole sized to receive a conventional pointed golf tee.

3. The golfer's aid of claim 2 further including means for holding the aid in any position along the length of a golf tee inserted through said hole.

4. The golfer's aid of claim 1 wherein said means for identifying a teeing point is an elongated hole sized to receive a golf tee, said elongated hole allowing a golfer to adjust the position of the aid with respect to a golf ball on the tee.

5. The golfer's aid of claim 4 further including means for holding the aid in any position along the length of a golf tee inserted through said hole.

6. The golfer's aid of claim 1 wherein said means and markings are provided in a mat of a construction suitable for use at the teeing area of golf ball driving range.

7. The golfer's aid of claim 1 wherein said aid is symmetrical along an axis passing through said means for identifying a teeing point.

8. The golfer's aid of claim 7 wherein said aid includes a second set of markings that correspond to said first and second adjacent markings so that each pair of first and second adjacent markings are located on opposite sides of said axis, and said aid may be used by either a right or left handed golfer.

9. The golfer's aid of claim 1 wherein additional markings are provided to facilitate aiming the golf ball to a desired target and positioning the golfer's feet in a proper stance.

10. The golfer's aid of claim 1 wherein said golf ball image is a spherical golf ball.

11. The golfer's aid of claim 1 wherein said means for identifying a teeing point is a tee integrally connected to said aid to form a one-piece construction.

12. The golfer's aid of claim 1 wherein said means for identifying a teeing point is an elevated platform on said aid for holding a golf ball.

13. A golfer's aid for consistently executing a proper golf club swing consisting essentially of:

a substantially horizontal surface;

means for identifying a teeing point disposed on said surface;

first and second adjacent markings spaced apart from each other and at predetermined distances substantially linearly from said teeing point, the distance between said first marking and said teeing point being greater than the distance between said second marking and said teeing point, and the distance between said first marking and said teeing point being such that when a spherical golf ball having a diameter of substantially 1.68 inches is positioned on said teeing point, and said thus positioned golf ball is being addressed by a golfer in a substantially proper golfing stance, said first marking is substantially obscured from said golfer's view by said thus positioned golf ball, and as said golfer executes a back swing and leans rearward, in a direction opposite the direction in which the golfball is to be driven, said second marking will come into said golfer's view and indicate the achievement of a substantially proper final set-up just before a down swing of the golf club begins.

14. The golfer's aid of claim 13 wherein said means for identifying a teeing point is a hole sized to receive a conventional pointed golf tee.

15. The golfer's aid of claim 14 further including means for holding the aid in any position along the length of a golf tee inserted through said hole.

16. The golfer's aid of claim 13 wherein said means for identifying a teeing point is an elongated hole sized to receive a golf tee, said elongated hole allowing a golfer to adjust the position of the aid with respect to a golf ball on the tee.

17. The golfer's aid of claim 16 further including means for holding the aid in any position along the length of a golf tee inserted through said hole.

18. The golfer's aid of claim 13 wherein said means and markings are provided in a mat of a construction suitable for use at the teeing area of golf ball driving range.

19. The golfer's aid of claim 13 wherein said aid is symmetrical along an axis passing through said means for identifying a teeing point.

20. The golfer's aid of claim 13 wherein said aid includes a second set of markings that correspond to said first and second adjacent markings so that each pair of first and second adjacent markings are located on opposite sides of said axis, and said aid may be used by either a right or left handed golfer.

21. The golfer's aid of claim 13 wherein additional markings are provided to facilitate aiming the golf ball to a desired target and positioning golfer's feet in a proper stance.

22. The golfer's aid of claim 13 wherein said means for identifying a teeing point is a tee integrally connected to said aid to form a one-piece construction.

23. The golfer's aid of claim 13 wherein said means for identifying a teeing point is an elevated platform on said aid for holding a golf ball.

24. A golfer's aid for consistently executing a proper golf club swing comprising: a horizontal surface, means for identifying a teeing point at which a spherical golf ball having a predetermined diameter may be positioned, first and second adjacent markings spaced apart from each other and at predetermined distances linearly from said teeing point, the distance between said first marking and said teeing point being greater than the distance between said second marking and said teeing point, and the distance between said first marking and said teeing point being such that when a golf ball is positioned on said teeing point, and said thus positioned golf ball is being addressed by a golfer in a proper golfing stance, said first marking is obscured from said golfer's view by said thus positioned golf ball, and as said golfer executes a back swing and leans rearward, in the direction opposite the direction in which the golf ball is to be driven, said second marking will come into said golfer's view and indicate the achievement of a proper final set-up just before the down swing of the golf club begins.

25. The golfer's aid of claim 24 wherein said means for identifying a teeing point is a hole sized to receive a conventional pointed golf tee.

26. The golfer's aid of claim 25 further including means for holding the aid in any position along the length of a golf tee inserted through said hole.

27. The golfer's aid of claim 24 wherein said means for identifying a teeing point is an elongated hole sized to receive a golf tee, said elongated hole allowing a golfer to adjust the position of the aid with respect to a golf ball on the tee.

28. The golfer's aid of claim 27 further including means for holding the aid in any position along the length of a golf tee inserted through said hole.

29. The golfer's aid of claim 24 wherein said means and markings are provided in a mat of a construction suitable for use at the teeing area of golf ball driving range.

30. The golfer's aid of claim 24 wherein said aid is symmetrical along an axis passing through said means for identifying a teeing point.

31. The golfer's aid of claim 30 wherein said aid includes a second set of markings that correspond to said first and second adjacent markings so that each pair of first and second adjacent markings are located on opposite sides of said axis, and said aid may be used by either a right or left handed golfer.

32. The golfer's aid of claim 24 wherein additional markings are provided to facilitate aiming the golf ball to a desired target and positioning golfer's feet in a proper stance.

33. The golfer's aid of claim 24 wherein said means for identifying a teeing point is a tee integrally connected to said aid to form a one-piece construction.

34. The golfer's aid of claim 24 wherein said means for identifying a teeing point is an elevated platform on said aid for holding a golf ball.

* * * * *